US005456518A

United States Patent [19]

Kemppainen et al.

[11] Patent Number: 5,456,518

[45] Date of Patent: Oct. 10, 1995

[54] FLEXIBLE ACCESS SEATING

[75] Inventors: Thomas R. Kemppainen, Hastings; Kristen M. Sigourney, Galesburg; Melvin J. Guiles, Casnovia, all of Mich.; Masanori Karita, Tokyo, Japan

[73] Assignee: Interkal, Inc., Kalamazoo, Mich.

[21] Appl. No.: 100,593

[22] Filed: Jul. 30, 1993

[51] Int. Cl.[6] ..... A47C 15/00

[52] U.S. Cl. ..... 297/240; 297/248; 297/232; 297/242

[58] Field of Search ..... 297/248, 249, 297/232, 234, 239–242, 257, 331, 354.1

[56] References Cited

U.S. PATENT DOCUMENTS

| | | | |
|---|---|---|---|
| 1,942,752 | 1/1934 | Gedris | 297/249 |
| 2,542,653 | 2/1951 | Frydenlund | 297/234 X |
| 2,595,921 | 5/1952 | Butz | 297/234 |
| 3,002,787 | 10/1961 | Ziegenfuss | 297/249 |
| 3,146,025 | 8/1964 | Heaney | 297/248 |
| 3,774,962 | 11/1973 | Watamura et al. | 297/249 |
| 4,662,679 | 5/1987 | Franck et al. | 297/249 X |

FOREIGN PATENT DOCUMENTS

| | | | |
|---|---|---|---|
| 0729469 | 7/1932 | France | 297/234 |
| 0761821 | 3/1934 | France | 297/234 |

*Primary Examiner*—Kenneth J. Dorner
*Assistant Examiner*—Milton Nelson, Jr.
*Attorney, Agent, or Firm*—David I. Roche

[57] ABSTRACT

A seating system capable of being put into a variety of configurations which include wheelchair locations. The seating arrangement is made up of two-chair and three-chair units in which at least one fixed chair is included within each unit. Stowable chairs are attached by hinges to the fixed chairs and can be moved from stowed positions behind the fixed chairs to use positions between the fixed chairs. Latches are used to hold the stowable and fixed chairs in a row while in their use positions. Hinges allow planar horizontal rotation of the stowable chairs to their stowed positions.

15 Claims, 6 Drawing Sheets

24
20
18
14
27
30
28
81
47
34
83
48
57
49
58
33
56
59
50
60
62
67
72
66
64
44
46
42
45

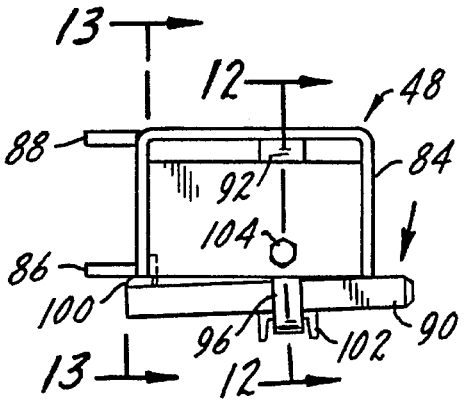
Fig. 11.
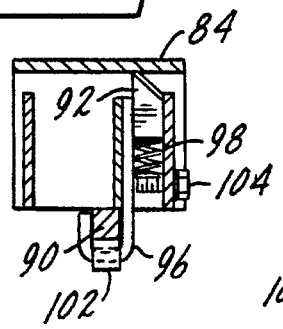
Fig. 12.
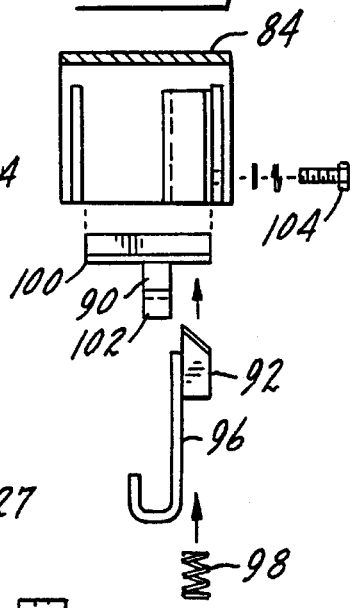
Fig. 13.
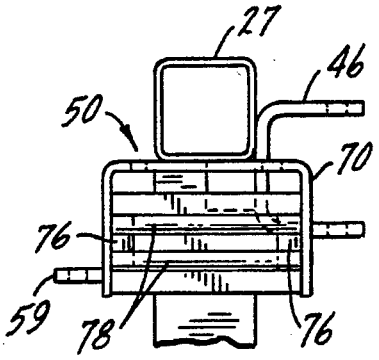
Fig. 16.
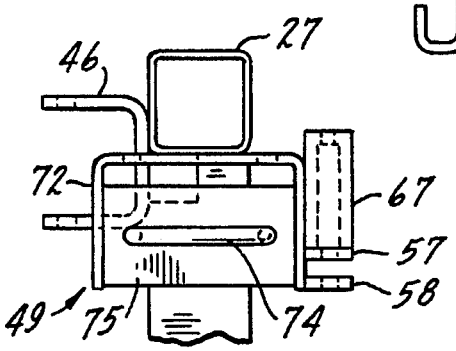
Fig. 17.
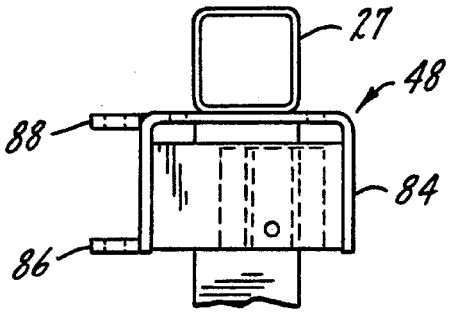
Fig. 18.
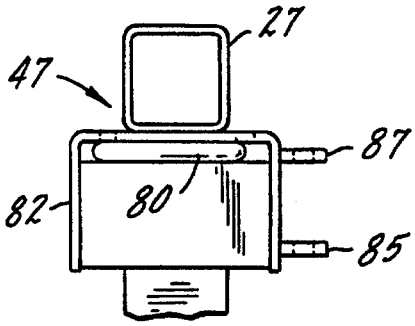
Fig. 19.
Fig. 20.
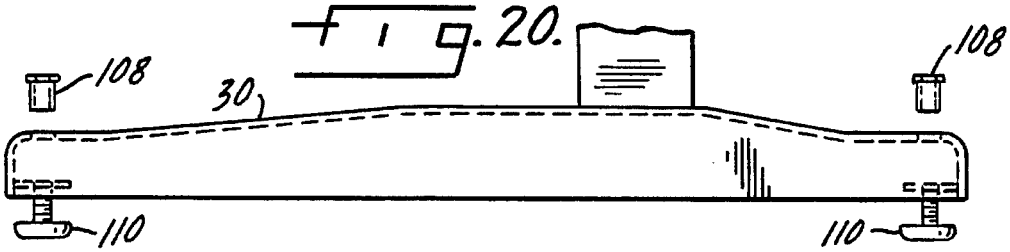

FLEXIBLE ACCESS SEATING

BACKGROUND AND SUMMARY OF THE INVENTION

The present invention relates to a seating system which is capable of accommodating wheelchairs, and in particular, relates to a seating system in which wheelchair locations are provided with adjacent non-wheelchair seating and in which stowable chairs can be easily moved into the wheelchair locations when space for wheelchairs is not required.

At the present time, the guidelines of the Americans with Disabilities Act (the "ADA") provide that when seating capacity exceeds 300, wheelchair spaces accessible to wheelchair users must be provided at a plurality of locations. Providing permanent wheelchair locations may result in the loss of ticket revenue, unless standard seating can be used in the unused wheelchair locations. To facilitate the use of wheelchair locations for standard seating, various folding seating designs have been developed. For example, a storable seating unit is shown and described in U.S. Pat. No. 5,201,567. A similar seating arrangement referred to as the "Equal Access System" is available from American Seating Company. In these systems, a storable seating unit is foldable and pivotable in the forward direction to a stored position leaving an empty space for a wheelchair. In both of the systems shown in U.S. Pat. No. 5,201,567 and in the Equal Access System, the stowed seat rotates forward and acts as a divider which separates the wheelchair user from an adjacent seat. If two adjacent wheelchair spaces are desired in these systems, the two adjacent wheelchair occupants are isolated from the standard seating on each side of the double wheelchair space. Furthermore, since providing space for two adjacent wheelchairs requires the space normally occupied by three standard (i.e. non-wheelchair) seats, the systems described in U.S. Pat. No. 5,201,567 and the Easy Access System of American Seating Company do not maximize the space available when a double wheelchair space is not used.

It is an object of the present invention to provide a seating system which allows for flexibility in the use of wheelchair locations.

It is another object of the present invention to provide a seating system in which a variety of wheelchair locations are available throughout a facility without sacrificing the seating capacity of the facility when wheelchair locations are unused.

Yet another object of the present invention is to provide a seating system which includes stowable seats which are comfortable and easily moved between a stowed and a used position.

Still another object of the present invention is to provide a seating system which includes wheelchair locations having adjacent companion seats available for non-handicapped persons who accompany wheelchair users.

A further object of the present invention is to provide a seating system in which two adjacent wheelchair locations are provided, each having a companion seat.

Yet a further object of the present invention is to provide a seating system in which stowable seats are lockable in use positions, and easily moved from use positions to stowed positions.

Still a further object of the present invention is to provide a seating system in which the hinges and latches used in the movement of the stowable seats from use to stowed positions are sturdy, economical to manufacture and reliable in operation.

Some or all of the advantages of the present invention may be achieved with a seating system comprised of a plurality of stowable seats which are hingedly connected to a fixed seat. The fixed and stowable seats are aligned in a row such that two of the stowable seats can be stowed to create a single wheelchair space, and three stowable seats can be stowed to form a double wheelchair space. The three stowable seats are disposed between two fixed seats, which are not stowable, but which can be used as companion seating adjacent to wheelchair users occupying the wheelchair locations. The two stowable seats which are stowed to create the single wheelchair location are hingedly connected to one another by a simple hinge, and a second, complex hinge connects the pair of stowable seats to an adjacent fixed seat.

To create the double wheelchair space, the first two stowable seats are stowed behind the first fixed chair, and a third stowable seat, initially adjacent to the second stowable seat, is stowed behind a second fixed seat, which is initially adjacent to the third stowable seat. The third stowable seat and the second fixed seat are connected by a complex hinge which includes a hinge link. A similar complex hinge connects the first fixed seat and the first stowable seat. The hinge link separates the fixed seat in each case from the stowed seats which are disposed immediately behind the respective fixed seat so as not to interfere with the folding and unfolding of the fixed seat.

The latches and hinges used to connect and disconnect the various components of the stowable and fixed seats of the present invention, which are described in more detail below, are designed for heavy-duty, durable and trouble-free use. The latches of the present invention lock the stowable seats in use positions so that the stowable seats can be used when wheelchair locations are not required. Each of the stowable seats includes a post and pedestal assembly which, together with the hinged connections, provides the stowable seats with excellent structural stability.

The foregoing objects and advantages of the seating system of the present invention will be better understood upon reading the following specification in conjunction with the accompanying drawings.

BRIEF DESCRIPTION OF THE DRAWINGS

FIG. 11 through 13 are elevational views showing the components of the latch assembly used to releasably lock the position of a third chair of a three-chair assembly with respect to the middle chair thereof.

FIG. 16 is a right end view of the left end section of the assembly shown in FIGS. 14 and 15.

FIG. 17 is a left end view of the middle section of the assembly shown in FIGS. 14 and 15.

FIG. 18 is a right end view of the middle section of the assembly shown in FIGS. 14 and 15.

FIG. 19 is a left end view of the right end section of the assembly shown in FIGS. 14 and 15.

FIG. 20 is an elevational view of the lower portion of a slidable pedestal of a plural chair assembly of the present invention.

DETAILED DESCRIPTION OF THE INVENTION

Figure 1:
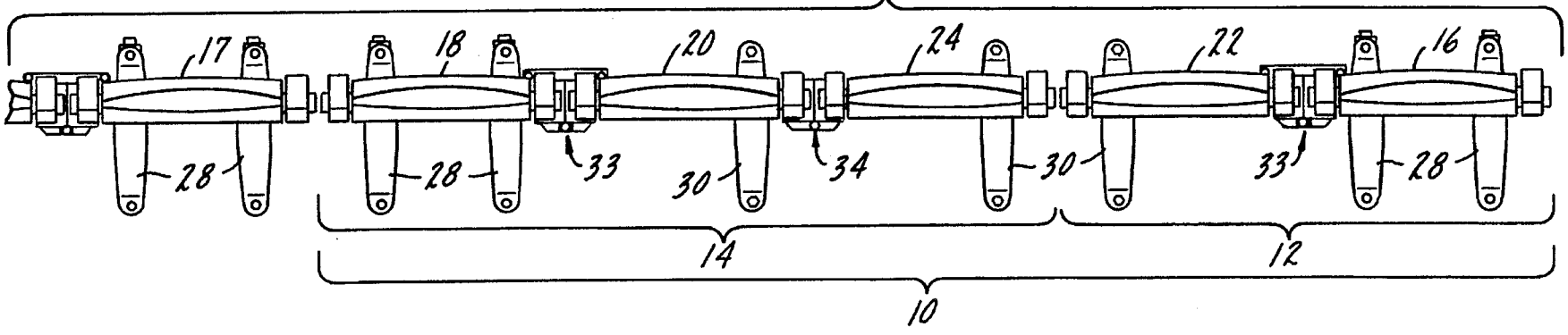
FIG. 1 is top view of a row of seats made in accordance with the present invention showing a two-chair and a three-chair assembly and a portion of a third assembly.
Figure 2:
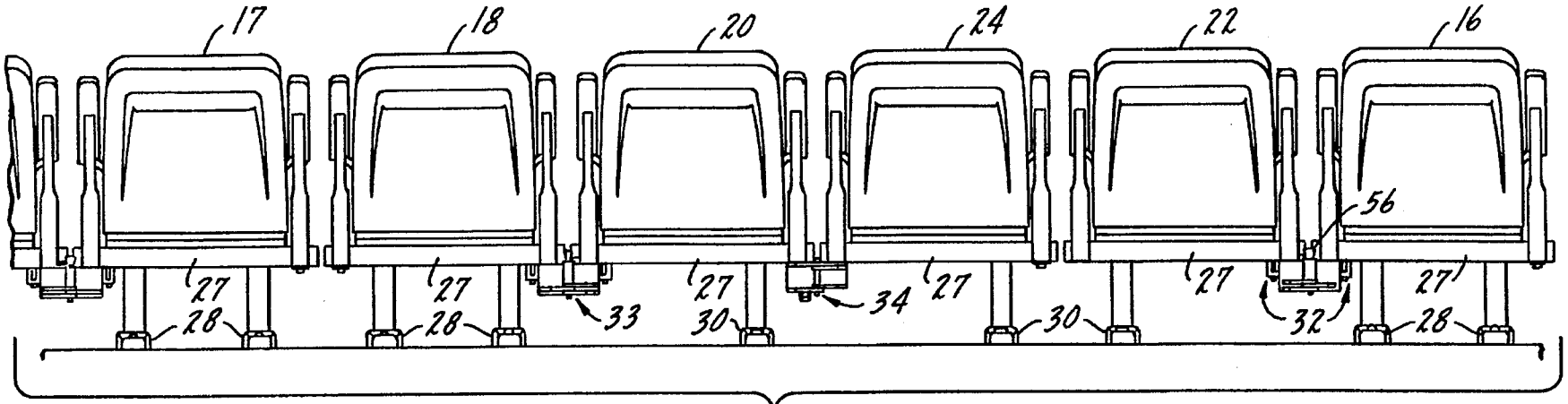
FIG. 2 is an elevational view of the row of seats shown in FIG. 1.

FIGS. 1 and 2 are plan and elevational views, respectively, of the repeating pattern 10 in a row of stowable and fixed chairs which may be used in practicing the present invention. The repeating pattern shown in FIGS. 1 and 2 is comprised of a right-hand two-chair unit 12 and a left-hand three-chair unit 14. The two-chair unit 12 is comprised of a base chair 16, having two fixed pedestals 28 and a stowable end chair 22. The three-chair unit 14 is comprised of a left-hand base chair 18 having two fixed pedestals 28 to which are connected a stowable middle chair 20 and a stowable end chair 24. The stowable chairs 20, 22 and 24 each have a single sliding pedestal 30. The fixed chair 17 is the first unit of the next combination of two-chair and three-chair units, and may be a fixed chair of a right-hand three-chair unit or a fixed chair of a left- hand two-chair unit. A right-hand three-chair unit would be one having a mirror image of the left-hand three-chair unit 14 shown in FIG. 1. Similarly, a left-hand two-chair unit would be the mirror image of the right-hand two-chair unit 12 shown in FIG. 1. Depending upon the length of the row in which the units are disposed, and depending upon the number of wheelchair locations required for a given site, various combinations of two-chair and three-chair units, both left-hand and right-hand, may be used. The two pedestals 28 of the fixed chair 18 (and the corresponding pedestals of the fixed chair 17) are rigidly fixed to the support surface, which in most instances is a concrete deck.

Figures 3, 4:
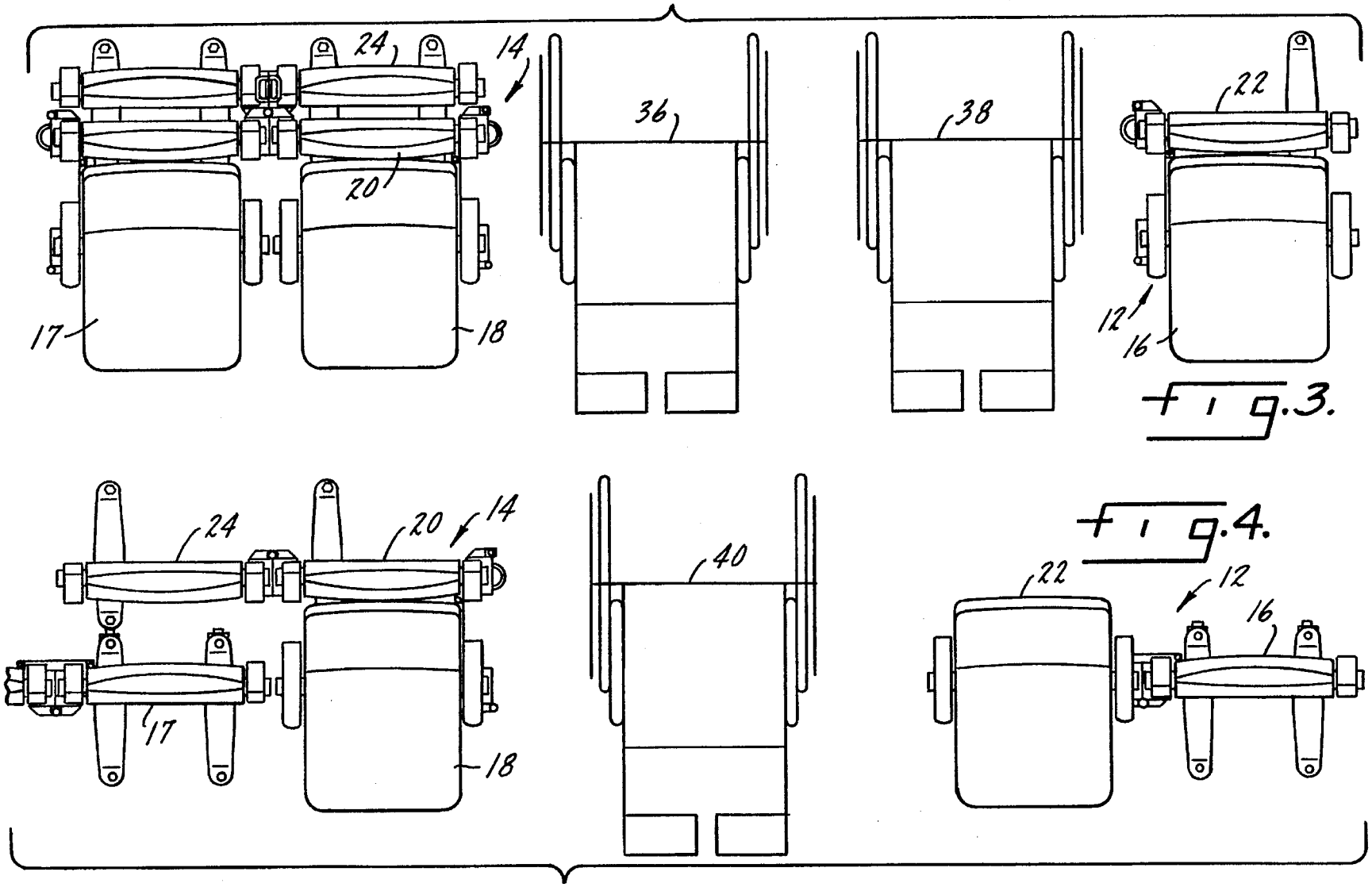
FIG. 3 is a top plan view showing a configuration in which two wheelchairs are accommodated by a row of seats embodying the present invention.
FIG. 4 is a top plan view showing a configuration in which a single wheelchair is accommodated.

FIG. 3 shows the repeating pattern 10 of the present invention as a configuration which accommodates two wheelchairs, 36 and 38. The two-chair unit 12 is configured such that the stowable end chair 22 is stowed just behind the fixed chair 16. The stowable chairs 20 and 24 are completely retracted into stowable positions behind the fixed chair 18.

FIG. 4 shows an alternative configuration of the repeating pattern 10 in which a single wheelchair location for wheelchair 40 is provided. In FIG. 4, the stowable chair 22 is in a use position adjacent to the fixed chair 16, and the stowable chairs 20 and 24 are in a less than fully retracted but stowed position behind the fixed chair 18. One of the differences between the configurations shown in FIGS. 3 and 4 is the position of the stowable chair 24. In FIG. 3, the stowable chair 24 is rotated directly behind the fixed chair 18. In FIG. 4, the stowable chair 24 is in an end-to-end relationship with the stowable chair 20. The configuration shown in FIG. 4 with stowable chairs 20 and 24 in an end-to-end relationship provides more area for movement behind the row of seating.

Figure 5:
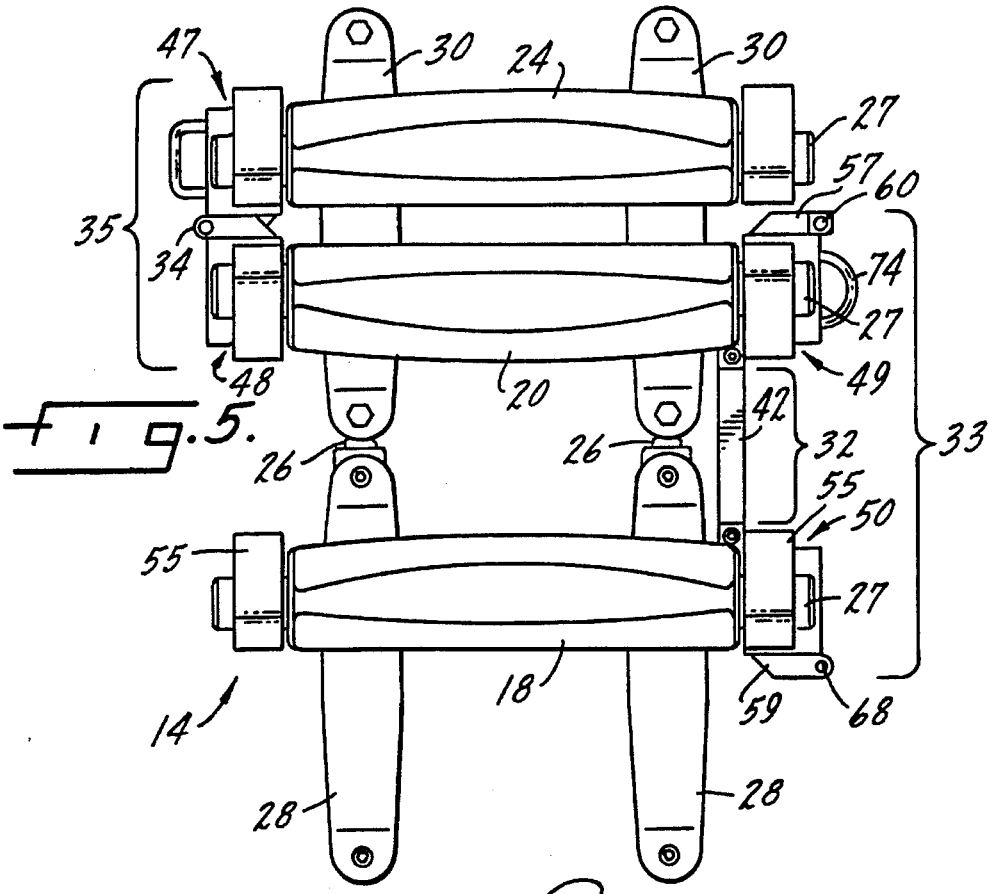
FIG. 5 is a top plan view of a three-chair assembly with two of the three chairs in a stowed position.
Figure 6:
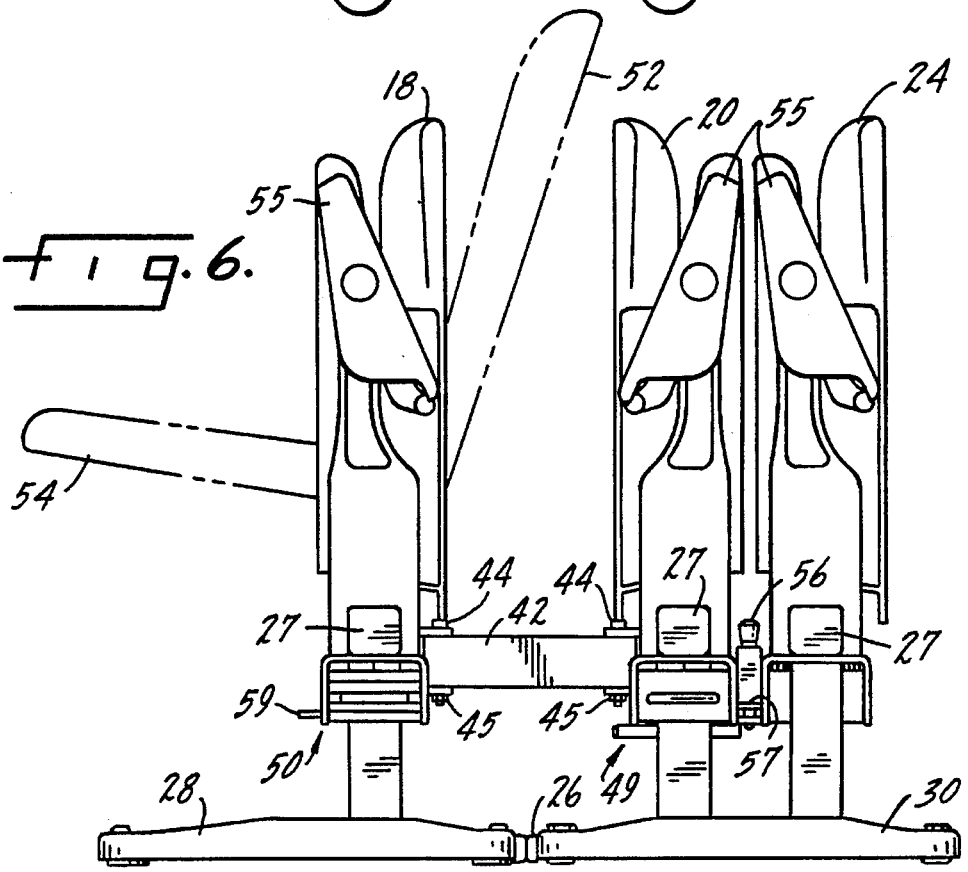
FIG. 6 is an elevational view of the three-chair assembly shown in FIG. 5.

FIGS. 5 and 6 are top plan and elevational views, respectively, of the three-chair unit 14 in a fully retracted position as shown in FIG. 3. The bumpers 26 on the back of pedestals 28 are aligned with the front ends of the sliding pedestals 30 which support the middle stowable chair 20 and the end stowable chair 24. FIG. 5 also shows the complex hinge 32, which connects the middle stowable chair 20 and the fixed chair 18, and the simple hinge 34 which connects the middle chair 20 to the stowable end chair 24.

There are two kinds of latches which are used to control rotational movement of the chairs 20 and 24 which comprise the three-chair unit 14. The simple latch 35 associated with the simple hinge 34 is comprised of a male part 47 and a female part 48, which are separated in the configuration shown in FIG. 5. Similarly, the complex latch 33 associated with the complex hinge 32 is comprised of a male part 49 and a female part 50 which are separated when the three-chair assembly is in the configuration shown in FIG. 5.

As can be seen from FIG. 6, the hinge link 42 provides sufficient space between the stowed chair 20 and the fixed chair 18 so that the lowering of the seat back 52 (and the resulting lowering of the seat pan 54 and armrest 55) does not interfere with or result in contact between the seat pan of the chair 20 and the seat back 52.

Figures 7, 8, 9, 10:
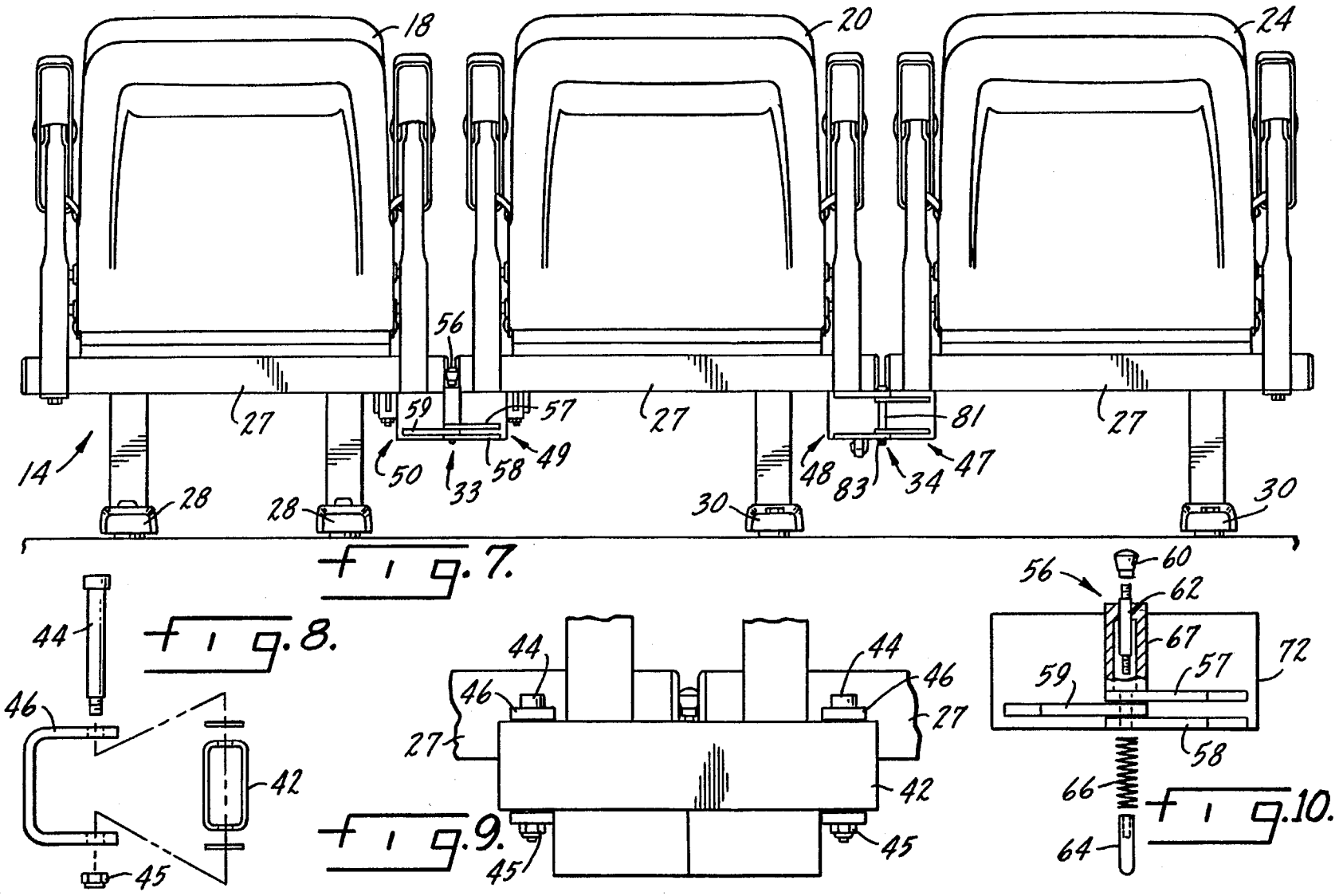
FIG. 7 is an elevational view of a three-chair assembly of the present invention in an extended, non-folded position.
FIG. 8 is an exploded view of the hinge pin assembly by which two chairs of the assembly shown in FIG. 7 are connected.
FIG. 9 is a rear elevational view of a hinge tube used to connect the middle chair of a three-chair assembly to the base chairs of such assembly.
FIG. 10 is an elevational view of a lock pin assembly by which two chairs of a plural-chair assembly of the present invention are releasably locked in an extended, non-folded position.
Figure 14:
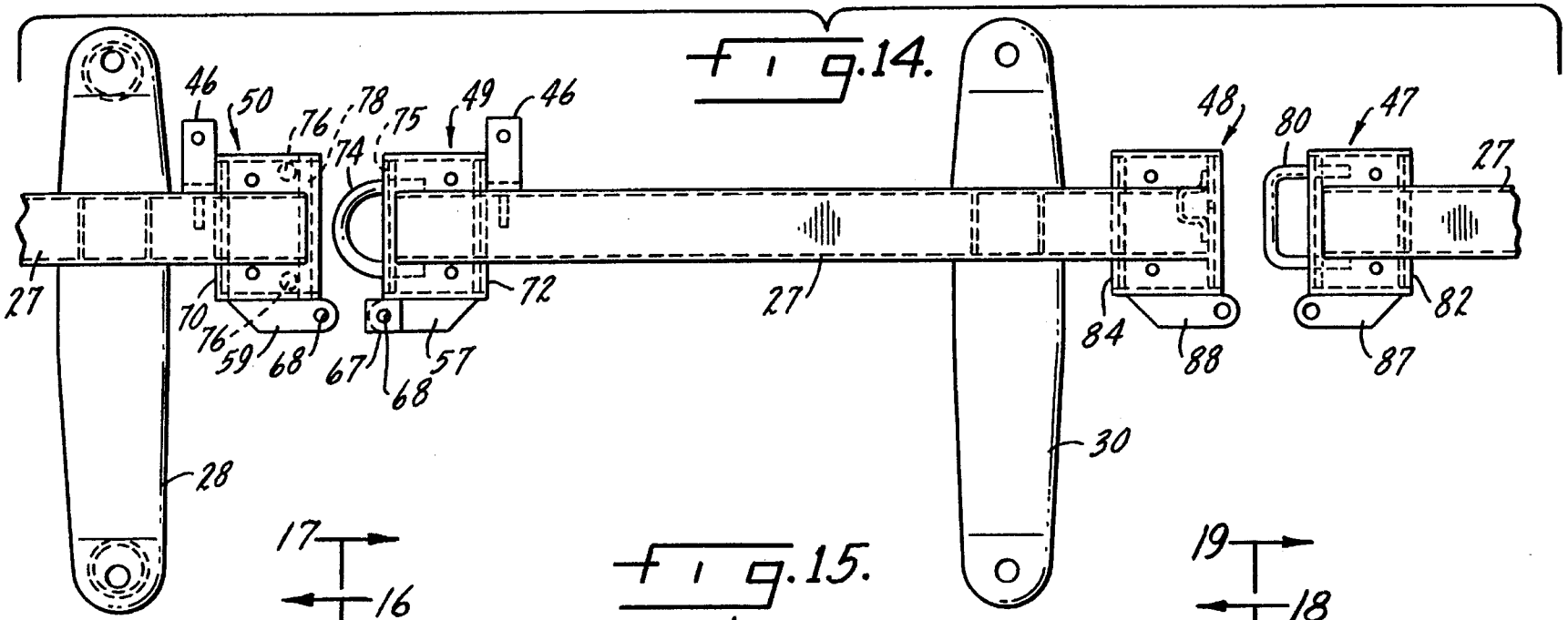
FIG. 14 is a longitudinally exploded plan view of the hinges which are used in a three-chair assembly of the present invention.
Figure 15:
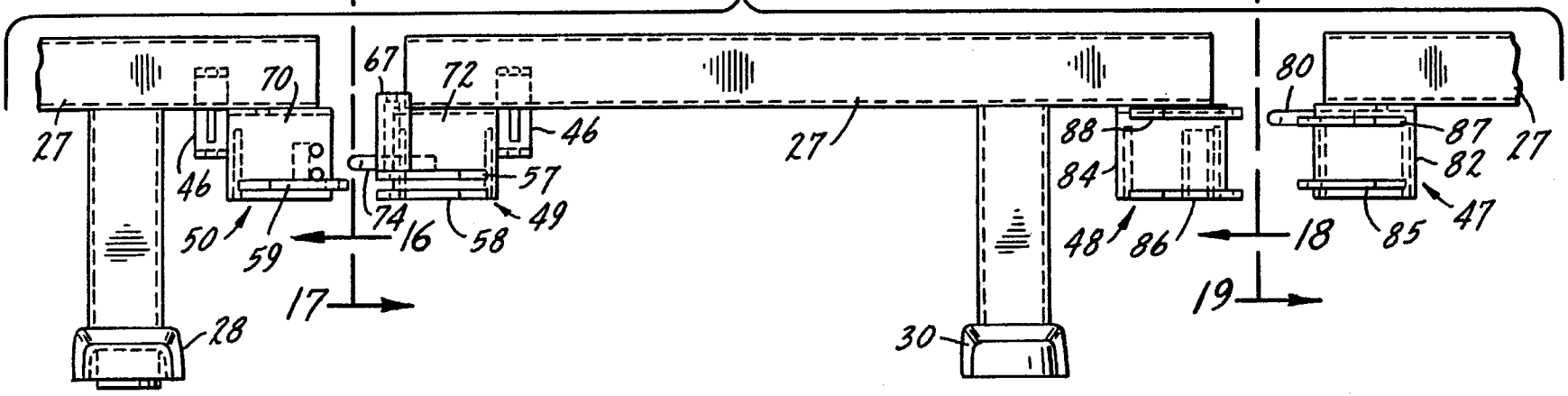
FIG. 15 is an elevational view of the assembly shown in FIG. 14.

FIG. 7 shows more detail of the three-chair assembly 14 when the stowable chairs 20 and 24 are in their use positions. In addition, some of the details of the complex latch 33 and the simple hinge 34 can be seen in FIG. 7. When the latch is operating to hold the fixed chair 18 and the stowable chair 20 in their use positions, three pin flanges 57, 58 and 59, each having a lock pin aperture, come together to allow the lock pin 56 to maintain the chairs 18 and 20 in end-to-end alignment.

FIG. 8 shows the C-bracket 46, by which the fixed chairs 18 and 20 are connected to the hinge link 42. While not shown in FIG. 8, the C-bracket 46 is welded to the horizontal support tube 27. A shouldered bolt 44 and a corresponding nut 45 are used to complete the attachment of the C-brackets 46 to the hinge link 42.

FIG. 10 shows the details of the lock pin 56. The lock pin 56 is comprised of a knob 60, a lock pin shaft 62 and a lock pin tip 64. A spring 66 pushes the lock pin 56 in a downward direction through the apertures in lock pin flanges 57, 58 and 59 when the chairs 18 and 20 are in an end-to-end arrangement. The several components of the lock pin 56 are contained within a lock pin housing 67 mounted to the upper lock pin flange 57. The lock pin flanges 57 and 58 are welded to the housing 72 of the male part 49 of the complex hinge 32. Similarly, the center lock pin 59 flange is welded to the housing 70 of the female part 50 of the complex hinge 32.

As can be best seen in FIGS. 14 through 17, operation of the complex hinge 32 such that the apertures 68 are aligned could be difficult without some means for aligning the apertures 68. The alignment function is provided by the rounded U-bolt 74 carried by the male part 49 of the complex hinge 32 in conjunction with the horizontal guide bars 78 and vertical guide pins 76 contained within the female part 50 of the complex hinge 32. The rounded shape of the U-bolt 74, which is welded to a housing plate 75, allows for easy insertion of the U-bolt 74 into the space defined by the guide bars 78 and the guide pins 76. When the U-bolt 74 is fully inserted into the female part 50, the apertures 68 on the lock pin flanges 57, 58 and 59 are in alignment. That alignment allows the lock pin tip 64 to extend through the apertures locking the relative positions of the chair 18 and the chair 20.

In contrast, since the hinge 34 is a simple hinge, and male part 47 and female part 48 are not free to translate relative to each other, alignment of the male and female parts of the simple latch 35 is not a concern. As can be seen from FIGS. 14, 15, 18 and 19, the squared U-bolt 80 does not perform an alignment function. Rather, the squared U-bolt 80 simply cooperates with the latch pin 92 carried by the spring loaded J-bar 96 (see FIGS. 11 through 13) when the chairs 20 and 24 are brought into end-to-end relationship. The simple hinge 34 is primarily comprised of a bolt 81 and nut 83 arranged so that the bolt 81 extends through the apertures in the upper hinge plate 88 and lower hinge plate 86 on the female part 48 of the simple latch 35, as well as through the apertures in the upper hinge plate 87 and lower hinge plate 85 on the male part 47 of the simple latch 35. The hinged plates 86 and 88 are welded to the latch housing 84 of the female part of the simple latch 35, and the hinge plates 85 and 87 are welded to the housing 82 of the male part 47 of the simple latch 35.

FIGS. 11, 12 and 13 show the details of the female part 48 of the simple latch 35. A latch release bar 90 is mounted to the underside of a latch housing 84. An L-bar 100 and channel retainer 102 are welded to the latch release bar 90 to limit the axial and lateral movement of the latch release bar 90. The J-bar 96 is spring loaded and pushed upward by the spring 98, which is held in place by the screw 104. A latch pin 92 is welded to the end of the J-bar 96. The squared U-bolt 80 engages the sloped surface of the latch pin 92 when the chairs carrying the female part 48 and male part 47 are brought into end-to-end alignment.

FIG. 20 shows the lock nuts 108 and glides 110 which are mounted to the sliding pedestal 30 to facilitate the sliding action required when the stowable chairs are placed in their stowed positions.

In operation, a facility equipped with the seating arrangement of the present invention may be converted from a facility with no wheelchair spaces to one with several wheelchair spaces in a matter of minutes. A single wheelchair space with an adjacent fixed chair can be created by first pushing downward on the release bar 90 beneath the stowable chair 24 while rotating the chair 24 to a position in front of the stowable chair 20. Then, the latch pin 56 between chair 20 and chair 18 is lifted while the chairs 20 and 24 are rotated to a position directly behind chair 18. The use of latches or other retaining means to hold the chairs 20 and 24 in their stowed positions is optional, and no such latches or retention is shown herein, since forces tending to return the stowed chairs to their use positions would be minor and relatively unlikely. However, the latches used to hold the chairs 20 and 24 in their use positions need to be durable and strong since in their use positions the chairs 20 and 24 are likely to experience substantial forces (for example, from the resting of feet by occupants in the row behind the chairs) which would tend to move the chairs about the hinges by which they are connected, or otherwise tend to bring the chairs into their stowed positions.

If a second wheelchair space is desired, the single wheelchair space created by the stowing of chairs 20 and 24 may be expanded by the stowing of the stowable chair 22. This can be accomplished by lifting on the lock pin 56 located between the chairs 22 and 16, and rotating the chair 22 to its stowed position immediately behind the chair 16. The lock pins 56 need only be held in a lifted position for the first few degrees of rotation of the chair adjacent thereto. After a lock pin 56 is out of alignment with the aperture through which is it extends, the pin can be released without interfering with continued rotation of the chair 22 or chairs 20 and 24.

To return the chairs 20 and 24 from their stowed positions to their use positions, an operator first rotates the pair of chairs so that chair 20 is close to being in an end-to-end position with respect to chair 18. When the chair 20 is near the end of its rotation, the lock pin 56 should be lifted so that the apertures in the pin flanges 57, 58 and 59 can become vertically aligned. When rotation of the chairs 20 and 24 about the chair 18 is completed, the lock pin 56 should be lowered through the apertures in the flanges to lock the position of the chair 20 relative to chair 18. Then the chair 24 should be rotated to its position in end-to-end relation with chair 20. As the rotation of chair 24 nears its completion, the U-bolt 80 will automatically depress and pass by the latch pin 92. Return of the latch pin 92 to its upper position locks the chairs 24 and 20 in an end-to-end relationship.

Similar to the procedure used to return chair 20 to its use position adjacent to chair 18, the stowable chair 22 is returned to its use position by the simultaneous lifting of the lock pin 56 and rotation of the chair 22 to an end-to-end position with respect to chair 16.

The movement of the stowable chairs of the present invention between their stowed and use positions is simple and requires a minimal amount of training and a minimal amount of physical exertion, since essentially no lifting is required.

While a specific embodiment of the invention has been shown and described, it will be apparent to those skilled in the art that numerous alternatives, modifications, and variations of the embodiment shown can be made without departing from the spirit and scope of the appended claims.

We claim:

1. A seating system for accommodating wheelchairs, said system comprising at least one fixed chair with a base which is rigidly fixed to a support surface, at least one stowable chair connected to said fixed chair, said stowable chair being rotatable about said fixed chair between a stowed position and a use position, said stowed position being behind said fixed chair, said stowable chair being rotatable about said fixed chair in a horizontal plane, a latch holding said stowable chair in said use position, said latch requiring activation to release said stowable chair from said use position, said fixed chair and said stowable chair being joined by a hinged connection which includes a hinge link, said fixed chair being rotatably attached to one end of mid hinge link and said stowable chair being rotatably attached to an opposite end of said hinge link, whereby said stowable chair may be moved to a position behind said fixed chair without said stowed chair interfering with occupancy of said fixed chair.

2. A seating system in accordance with claim 1 wherein:

said latch comprises a lock pin carried by one of said chairs, said lock pin being capable of aligning with and extending through apertures in overlapping flanges carried by said fixed and stowable chairs.

3. A seating system in accordance with claim 1 wherein:

said system comprises a plurality of stowable chairs and a plurality of latches for maintaining said chairs in their use positions, a first stowable chair being connected to said fixed chair, and a second stowable chair being connected to a second fixed chair.

4. A seating system in accordance with claim 1 wherein:

said system comprises a plurality of stowable chairs and a plurality of latches for maintaining said chairs in their use positions, a first stowable chair being connected to said fixed chair, and a second stowable chair being connected to a second fixed chair.

5. A seating system in accordance with claim 1 wherein:

said system comprises at least two fixed chairs and at least three stowable chairs between and in a single row with said two fixed chairs, two of said stowable chairs being stowable behind a first fixed chair, and a third stowable chair being stowable behind a second fixed chair.

6. A seating system in accordance with claim 1 wherein:

said system includes at least two pairs of fixed chairs, a first pair of fixed chairs having three stowable chairs disposed between and in the same row as said first pair of two fixed chairs, one of the fixed chairs of said first pair having a single stowable chair hingedly attached thereto, and a second pair of said at least two pairs of fixed chairs having at least one stowable chair hingedly attached to a fixed chair of said second pair.

7. A seating system for accommodating wheelchairs comprising two folding non-stowable chairs and three folding stowable chairs connected to said non-stowable chairs by hinges, first and second stowable chairs being connected to a first non-stowable chair, said first stowable chair being connected to both said first non-stowable chair and said second stowable chair, a third stowable chair being connected to said second non-stowable chair, a first latch capable of holding said first and second stowable chairs in adjacent use positions, a second latch capable of holding said first stowable chair and said first non-stowable chair in adjacent use positions, a third latch capable of holding said third stowable chair and said second non-stowable chair in adjacent use positions, said first and second stowable chairs being movable about said first non-stowable chair to provide a first space for a first wheelchair, said third stowable chair being movable about said second non-stowable chair to provide a second space adjacent to said first space, said first and second spaces combining to form a combined space capable of receiving two wheelchairs adjacent to one another.

8. A seating system in accordance with claim 7 wherein:

said first, second and third latches are each comprised of a male latch part and a corresponding female latch part, said first latch being capable of unattended engagement, said second and third latches requiring lifting of a latch pin before engagement and disengagement of said male and female latch parts of said second and third latch parts can occur, said first latch requiring actuation of a latch release bar before disengagement of said male and female latch pans of said first latch can occur.

9. A seating system in accordance with claim 7 wherein:

each of said stowable and non-stowable chairs has a seat back, seat pan and a pair of armrests and is foldable to an upright position in which said seat back, seat pan and said armrests are generally parallel and assume a generally vertical orientation, and each of said chairs is capable of unfolding to a use position in which said seat pan and said seat back are at about a right angle with respect to each other and said armrests are generally horizontal.

10. A seating system in accordance with claim 7 wherein:

said hinges include a first hinge between said first and second stowable chairs, a second hinge between said first stowable chair and said first non-stowable chair, and a third hinge between said third stowable chair and said second non-stowable chair.

11. A seating system in accordance with claim 10 wherein:

said first hinge is comprised of a single hinge pin and said second and third hinges are each comprised of two hinge pins and a movable hinge link between said two hinge pins.

12. A seating system for accommodating wheelchairs, said system comprising at least one fixed chair with a base which is rigidly fixed to a support surface, at least one stowable chair connected to said fixed chair, said stowable chair being rotatable about said fixed chair between a stowed position and a use position, said stowed position being behind said fixed chair, said system further comprising at least one additional stowable chair and a plurality of latches for maintaining said stowable chairs in their use positions, a first stowable chair being connected to said fixed chair, and a second stowable chair being connected to said first stowable chair.

13. A seating system for accommodating wheelchairs, said system comprising at least one fixed chair with a base which is rigidly fixed to a support surface, at least one stowable chair connected to said fixed chair, said stowable chair being rotatable about said fixed chair between a stowed position and a use position, said stowed position being behind said fixed chair, said system further comprising at least one additional stowable chair and a plurality of latches for maintaining said chairs in their use positions, a first stowable chair being connected to said fixed chair, and a second stowable chair being connected to a second fixed chair.

14. A seating system for accommodating wheelchairs, said system comprising at least one fixed chair with a base which is rigidly fixed to a support surface, at least one stowable chair connected to said fixed chair, said stowable chair being rotatable about said fixed chair between a stowed position and a use position, said stowed position being behind said fixed chair, said system further comprising at least one additional fixed chair and at least three stowable chairs between and in a single row with said two fixed chairs, two of said stowable chairs being stowable behind a first fixed chair, and a third stowable chair being stowable behind a second fixed chair.

15. A seating system for accommodating wheelchairs, said system comprising at least one fixed chair with a base which is rigidly fixed to a support surface, at least one stowable chair connected to said fixed chair, said stowable chair being rotatable about said fixed chair between a stowed position and a use position, said stowed position being behind said fixed chair, said system including at least two pairs of fixed chairs, a first pair of fixed chairs having three stowable chairs disposed between and in a row with said first pair of two fixed chairs, a single stowable chair being adjacent to one of the fixed chairs of said first pair, and a second pair of said at least two pairs of fixed chairs having at least one stowable chair hingedly attached to each fixed chair of said second pair.

* * * * *